United States Patent [19]

Young

[11] 4,121,602

[45] Oct. 24, 1978

[54] HAIR OIL APPLICATOR

[76] Inventor: Joseph Young, 534 E. 37th St., Chicago, Ill. 60653

[21] Appl. No.: 821,387

[22] Filed: Aug. 3, 1977

[51] Int. Cl.[2] ..... A45D 24/22

[52] U.S. Cl. ..... 132/113

[58] Field of Search ..... 132/112–118, 132/147, 153

[56] References Cited

U.S. PATENT DOCUMENTS

| | | | |
|---|---|---|---|
| 1,693,248 | 11/1928 | Newton | 132/114 |
| 1,770,943 | 7/1930 | Newton | 132/114 |
| 1,852,617 | 4/1932 | Lamothe | 132/113 |

FOREIGN PATENT DOCUMENTS

| | | | |
|---|---|---|---|
| 1,100,890 | 3/1961 | Fed. Rep. of Germany | 132/113 |

*Primary Examiner*—G.E. McNeill
*Attorney, Agent, or Firm*—Bernard L. Kleinke

[57] ABSTRACT

An applicator for guiding a heated treating composition, such as hair oil, to the person of the user includes a container having a chamber therein for confining the composition, the container being mounted in a hollow body member having a handle portion thereon. The container is composed of a heat conducting material to permit the composition to be heated in the chamber. At least one hollow tube-like tooth is connected in fluid communication with the interior of the container and terminating in an opposite open distal end for flowing the heated composition from the container means through the hollow interior of the tooth and out its open distal end.

4 Claims, 3 Drawing Figures

HAIR OIL APPLICATOR

The present invention relates in general to an applicator for guiding heated treating compositions to the person of the user, and it more particularly relates to an applicator for supplying a heated hair oil to the scalp of a person.

In the past, hot oil treatments have been applied to the hair and scalp of persons for conditioning purposes. Such a hot oil treatment is time consuming and a tedious process. Ordinarily, the hair must be parted in a number of places, and then the oil or grease is heated to liquify it. The liquified oil or grease is then applied directly to the scalp at the areas thereof where the hair is parted. Thereafter, the oil or grease is then massaged into the scalp and distributed throughout the hair. Therefore, it would be highly desirable to have an applicator which would permit the treating materials to be applied in a convenient manner without the necessity of time consuming and awkward manipulations, such as parting the hair. Also, such an applicator should be readily and conveniently cleanable after its use.

Therefore, the principal object of the present invention is to provide a new and improved applicator for guiding treating materials to the person of the user in a convenient manner.

Another object of the present invention is to provide such a new and improved applicator, which can be readily and conveniently cleaned.

Briefly, the above and further objects of the present invention are realized by providing a container defining a chamber for confining the treating materials, the container being disposed in a hollow body member having a handle portion. The container is composed of heat conducting materials to permit the materials to be heated therein. At least one hollow tube-like tooth is connected in fluid communication with the interior of the container and depends from the body portion terminating in an opposite open distal end for flowing the heated materials from the container through the hollow interior of the tooth and out its open distal end. In one embodiment of the present invention, the container is heated electrically so that the treating materials, such as hair oil, may be heated in the container in a convenient manner so that the hair oil can flow through the hollow tooth to the person of the user. In another embodiment of the present invention, the entire chamber and the teeth are composed of metal material so that after the hair oil or grease is deposited in the chamber, the entire unit can be placed under a stream of hot water to liquify the oil or grease. Once the treating materials are heated, the applicator is held in the hand and the tooth is then guided through the hair so that the heated materials can be guided directly to the scalp.

The above, and still further highly important objects and advantages of the invention will become apparent from the following detailed specification, appended claims, and attached drawings, wherein:

Figure 1:
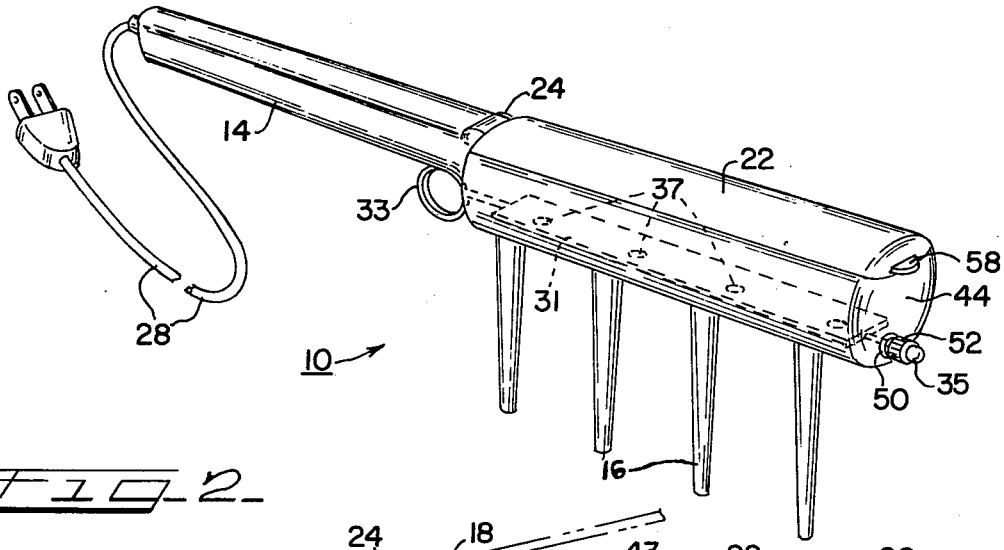
FIG. 1 is a pictorial view of an applicator which is constructed in accordance with the present invention.
Figure 2:
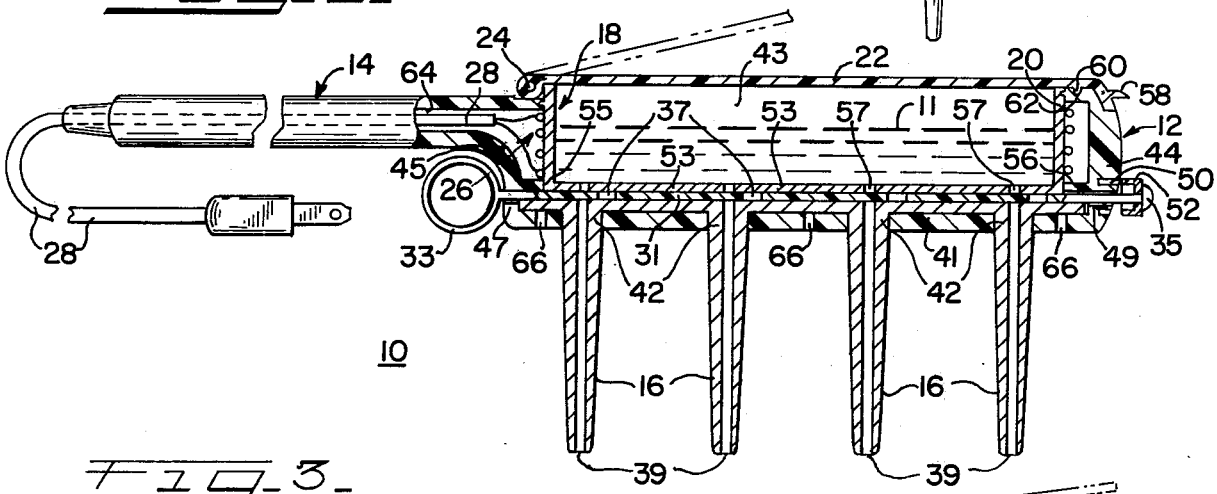
FIG. 2 is a fragmentary partly cross-sectional elevational view of the applicator of FIG. 1.

Referring now to the drawings, and more particularly to FIGS. 1 and 2 thereof, there is shown an applicator 10, which is constructed in accordance with the present invention, and which is adapted to guide heated hair oil or grease 11 confined therein to the hair and scalp of the user. It should be understood that various different types and kinds of hair oil and grease may be used or other similar preparations, and the applicator 10 may be used for applying the heated materials to other parts of the body as well. Also, the applicator 10 may be used not only for human beings, but also for animals as well.

The applicator 10 generally includes an elongated hollow body member 12, which has an elongated handle portion 14 extending rearwardly therefrom to be grasped by the hand of the user for supporting the applicator 10 in one hand during use.

A row of hollow tube-like teeth 16 depend from the underside of the hollow body member 12, and the teeth 16 are each connected in fluid communication with a container generally indicated at 18 mounted in the hollow interior of the body member 12 opposite an access opening 20 on the upper side of the body member 12. An access door 22 is hingedly attached at 24 to the body member 12 to close the access opening 20 during the use of the applicator 10.

Electric heating elements shown at 26 extend about the container 18 which is composed of a heat conducting material, such as a metal material so that the hair oil or grease 11 can be heated in the container 18. A power cord 28 is adapted to be connected electrically to a source of power for energizing the electric heating elements.

A slide 31 is normally disposed within the hollow body member 12 and forms the bottom wall of the container 18 to serve as a valve member or gate to retain the treating materials within the container 18 until a slide pull ring 33 on the outside of the hollow body member 12 below the handle 14 is pulled rearwardly to permit the heated treating materials to flow into the teeth 16. A slide stop 35 at the front end of the slide 31 on the outside of the body member 12 limits the rearward movement of the slide 31 to align a series of holes 37 in the slide 31 with the upper open end portions of the teeth 16 to permit the heated materials 11 to flow through the holes 37 and into the interior of the teeth 16.

In use, the door 22 swings to an open position so that the hair oil or grease 11 may be inserted through the access opening 20 into the interior of the container 18. Thereafter, the access door 22 is closed. The power cord 28 is then connected to a source of electrical energy for energizing the electric heating elements 26 extending about the outside of the container 18. As a result, the container 18 and the materials 11 are heated and liquefied to a flowable viscosity.

Thereafter, the slide pull ring 33 is then grasped by the finger of the user and pulled rearwardly until the holes 37 are disposed in axial alignment with the teeth 16 to permit the liquefied material 11 to fall under the force of gravity through the holes 37 and into the upper ends of the teeth 16.

The user then grasps the handle 14 and guides the applicator 11 with the teeth 16 extending into the hair and in the scalp area. The open distal ends 39 of the teeth 16 are disposed in close proximity to the scalp so that the liquefied material 11 flows through the hollow interior of the teeth 16 and out the open distal ends 39 for guiding the liquefied materials 11 directly to the scalp. Thus, the applicator 10 may be moved quickly through the hair and scalp to be treated for evenly and uniformly applying the materials 11 thereto in a very convenient manner.

At the completion of the treatment, the ring 33 may be grasped by the finger of the user to push the slide 31 back forwardly into the body portion 12 for moving the holes 37 out of alignment with the teeth 16 to prevent any further movement of the materials 11 out of the container 18.

Considering now the body member 12 in greater detail with reference to FIG. 2 of the drawings, the body member 12 includes a bottom wall 41 which has the teeth 16 depending therefrom and molded in a one-piece manner. The upper projecting open ends 42 of the teeth 16 extend into the interior of the body member 12. The body member 12 further includes side walls, such as the side wall 43, and a front end wall 44 and a rear end wall 45. A pair of oppositely disposed openings 47 and 49 in the respective rear end wall 45 and the front end wall 44 receive slidably the slide 31 whereby the pull ring 33 extends at the outside of the body member 12 at the rear end portion thereof and the front end of the slide 31 extends through the opening 49 at the front end of the body member 12.

An external annular grove 50 (FIG. 2) in the front end wall 44 receives an axially extending annular bead 52 on the slide stop 35 when the slide 31 is pulled rearwardly to a position for permitting the hair treating material 11 to flow into the hollow teeth 16. Thus, the annular bead 52 snaps into engagement with the groove 50 to retain releasably the slide 31 in its open position. When the user desires to move the slide 31 into its closed position, the bead 52 can be moved out of engagement with the groove 50 by moving the slide 31 in a forward direction.

The container 18 includes a bottom wall 53 and integrally connected side walls 54 with an open top. The container 18 is preferably composed of metal material, such as aluminum. The container 18 is disposed within an opening 55 in an inner bottom wall 56 of the body member 12.

In the bottom wall 53, there is provided a series of holes 57 positioned in axial alignment with the teeth 16, one of the holes 57 being provided for each one of the teeth 16 so that the liquefied hair treating material 11 can flow through the holes 15 and the holes 37 in the slide 31 and into the teeth 16. When the slide 31 is disposed in its closed position, the holes 37 in the slide 31 are disposed out of alignment with the holes 57 in the bottom wall of the container and the opened end portions 42 of the teeth 16.

The door 22 includes an extension 58 projecting forwardly beyond the plane of the front end wall 44 to serve as a finger grip for grasping the door 22 and pulling it into its open position. A latching bead 60 on the underside of the door 22 fits into a complementary-shaped opening 62 in the body member 12 to retain releasably the door 22 in its closed position.

The hollow interior 64 of the handle 14 receives the power cable 28 which is connected electrically to the electrical elements at 26.

In order to clean the applicator 10, the stop 35 can be removed from the slide 31, and the slide 31 can then be pulled out of the body member 12 for cleaning purposes. The door 22 can then be opened and the interior of the container 18 can be cleaned by holding the applicator 10 with its door 22 in its open position under running water to guide the water through the holes 57 in the bottom wall 53 of the container 18 and out the hollow teeth 16. In the event that water should collect under the inner wall 56, a series of holes 66 are provided in the outer bottom wall 41 to drain any water therefrom and preventing any accumulation of water therein. Thereafter, the slide 31 may be replaced in its position within the body member 12, and the stop 35 is then once again fastened at the forward end of the slide 31.

Figure 3:
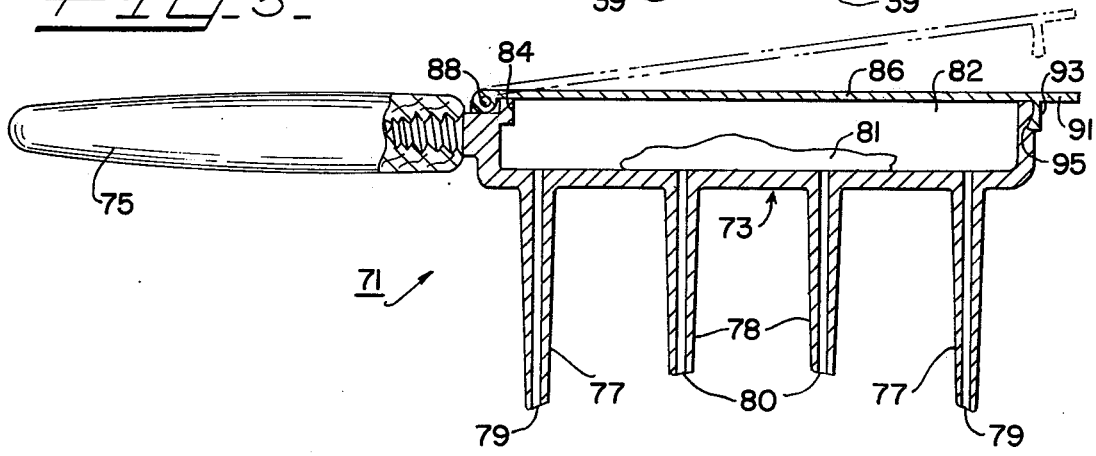
FIG. 3 is a partly cross-sectional view of another applicator which is also constructed in accordance with the present invention.

Referring now to FIG. 3 of the drawings, there is shown another applicator 71, which is constructed in accordance with the present invention and which is similar to the applicator 10 of FIGS. 1 and 2 except that the applicator 71 is adapted to supply heat to the hair treating material without the provision of electrical heating means. The applicator 71 generally comprises a hollow body 73 composed of metal material, and a wooden handle 75. A pair of integral hollow longer end teeth 77 and a plurality of shorter intermediate hollow teeth 78 are similar to the teeth 16, and they depend from the hollow body 73 in communication with the interior thereof. The open exit distal end portions 79 and 80 of the respective longer and shorter teeth 77 and 78 are arranged in an arcuate contour to conform to the head of the user. Hair treating material 81, such as hair oil or grease, may be positioned within the interior compartment 82 of the hollow body 73.

An access opening 84 permits the hair treating materials to be placed in the compartment 82, and an access door 86 hingedly connected at 88 to the hollow body member 73 closes over the access opening 84.

In use, once the hair treating material 81 is positioned within the compartment 82 as shown in the drawings, the applicator 71 is turned up-side-down with the teeth 77 and 78 extending upwardly. The applicator 71 is then placed under hot running water which conducts heat to the hollow body member 73 to in turn heat and thus liquefy the hair treating material 81. Thereafter, the applicator 71 can be turned right-side-up to permit the liquefied material 81 to flow under the force of gravity through the hollow teeth 77 and 78 to the hair and scalp of a person.

An extension 91 on the door 86 permits the door to be pulled open in a similar manner as the extension 58 of the applicator 10. A leg portion 93 depending from the door 86 carries an abutment 95 to snap into engagement with the body member 73 to retain releasably the door 86 in its closed position.

The applicator 71 can be readily cleaned by merely opening the door 86 and permitting hot water to flow into the compartment 82 and out the hollow teeth 77. The wooden handle 75 does not conduct heat, and thus the applicator 71 can be held under the flowing hot water without discomfort to the user.

It will be understood that changes may be made in the details of construction, arrangement and operation without departing from the spirit of the invention, especially as defined in the followng claims.

What is claimed is:

1. An applicator for guiding a heated treating material to the person of the user, comprising:

an elongated hollow body member generally circular in cross-section throughout its length;

a handle portion fixed to said body member;

container means defining a chamber for confining the treating material, said container means composed of heat conducting material to permit the material to be heated in said chamber;

up to four hollow tube-like teeth being connected in fluid communication with the interior of said container means in a widely spaced apart manner by more than twice the thickness of one of said teeth and depending from said body member terminating in an opposite open distal end for flowing the heated material from said container means through the hollow interior of said tooth and out its open distal end, said container means having an open mouth at the top side thereof, said hollow body includes means defining an access opening therein opposite said mouth of said container means for permitting access to the container means so that the material can be inserted through said access opening and said open mouth into said container means, a door being movably mounted on said body portion to move between an open position and a closed position over said access opening;

electrical heating means mounted in said body member for heating said container means, said heating means including resistance heating wires positioned in engagement with the outer walls of said container means, said outer walls being composed of metal material, said hollow body member being composed of plastic material;

said container means having a slidably mounted bottom wall, said wall including holes extending therethrough corresponding to said teeth, said wall being slidable laterally to move said holes out of axial alignment with the teeth to retain the material in said container means and to move said holes into axial alignment with the teeth to permit the material to flow from said container means through said holes and into the hollow interiors of said teeth;

said slidably mounted wall including a pull member fixed to it externally of said body member; and said slidably mounted wall including a single stop member removably fixed thereto externally to said body member and adapted to be removed to free said slidably mounted wall from said hollow body member.

2. An applicator according to claim 1, wherein said container means includes side walls having a plurality of openings therein for receiving said slidably mounted wall, a pair of wiping members mounted on said container means at said openings to retain said material within said container means.

3. An applicator according to claim 1, wherein said hollow body member, said container means and said tooth are of a unitary construction and are composed of metal material.

4. An applicator according to claim 1, wherein said elongated hollow body member includes means defining a plurality of openings in the underside thereof below said access opening to facilitate cleaning the interior of the applicator.

* * * * *